US005607021A

United States Patent [19]

Steele et al.

[11] Patent Number: 5,607,021

[45] Date of Patent: Mar. 4, 1997

[54] FIRE SUPPRESSION SYSTEM

[75] Inventors: Ron J. Steele, Spanaway; John W. Lambdin, Issaquah, both of Wash.

[73] Assignee: Weyerhaeuser Company, Tacoma, Wash.

[21] Appl. No.: 488,772

[22] Filed: Jun. 8, 1995

[51] Int. Cl.[6] ..... A62C 3/00

[52] U.S. Cl. ..... 169/54; 169/16; 169/61

[58] Field of Search ..... 169/54, 16, 56, 169/61

[56] References Cited

U.S. PATENT DOCUMENTS 766,232 8/1904 Erb et al. ..... 169/54

2,311,374 2/1943 Farmer et al. ..... 169/61

2,740,163 4/1956 Ferguson et al. ..... 169/54

3,912,015 10/1975 Garbee et al. ..... 169/61

4,063,595 12/1977 Phillips ..... 169/16

*Primary Examiner*—Gary C. Hoge

[57] ABSTRACT

In a typical industrial boiler installation the hot exhaust gases are directed through a conduit to a thermal heat exchanger where a closed circuit exchanger carries a flammable fluid such as oil. Located within this section is a plurality of liquid spray nozzles which, upon detection of a fire, spray an amount of cool liquid into the hot gas stream which flashes to steam, thereby cooling the equipment and suppressing the fire by supplanting the oxygen within the gas stream.

1 Claim, 1 Drawing Sheet

FIRE SUPPRESSION SYSTEM

BACKGROUND OF THE INVENTION

There are many industrial thermal fluid heat exchangers in use today. Many of them use a combustible oil as the circulating fluid. For example, in the wood panel manufacturing field many operating plants have a thermal oil heat exchanger in order to heat oil to temperatures whereby it can then be used to heat the hot presses within the plant. The heat exchangers are constructed within the exhaust ducting of typical industrial boilers. Unfortunately the gaseous stream from the combustion process can be quite hot (temperatures ±1,000° F. are common) and act to ignite any oil that flows from a leak within the closed circuit of the heat exchanger. Of course, continuous maintenance on the heat exchanger tubes will serve to reduce the occurrence of leaks but when one occurs, it would be very advantageous to have an automatic fire suppression system which controls the unwanted combustion, thereby preventing damage.

For example, in many thermal oil heat exchangers the flash point for a typically used oil is 380° F. The hot combustion exhaust gas stream can be at 1000° F. when entering the inlet end of the heat exchanger and if there is an oil leak, flashover will occur because the exhaust gas has enough oxygen to support combustion. 0n typical boilers using heat exchangers of the present type there can be residual oxygen in the range of 20% within the gas stream whereas it is usually felt that an oxygen level of 15% is the minimum amount required to support combustion.

Given these typical operating parameters, where an oil leak could result in a damaging fire, it has become a virtual requirement that some form of fire control means be provided. The present invention represents an improved fire suppression means for the general type of hot gas/flammable liquid environment where the hot gas can support combustion within a conduit. Our invention provides a source of liquid, external to the conduit, which is sprayed into the conduit when a fire is detected and is directed towards locations strategic to the source of the flammable fluid within the conduit. Nozzles create a fine mist spray and when the high temperature environment (fire conditions) transfers heat to the cooler spray it becomes steam which can then provide a cooling and smothering function as it is exhausted from the conduit. A sufficient amount of the fire control liquid is pumped through the nozzles to, in turn, create sufficient steam to supplant enough of the oxygen within the hot gas stream so that the steam can act to "snuff out" the fire. After the fire is controlled, suppressed and terminated, measures can be taken to repair leaks.

Thus, from the foregoing, one object of the present invention is to suppress a fire within a hot gas conduit having a source of flammable material therein.

Another object is to rapidly create an atmosphere within a hot gas conduit having an oxygen content below that which supports combustion of the flammable material therein.

Yet a further object is to reduce the temperature within the hot gas conduit about the area providing the source of flammable material thereby cooling the internal temperatures to levels that are safe.

These and other objects will become apparent upon reviewing the detailed description to follow in conjunction with the attached drawings.

SUMMARY OF THE INVENTION

Briefly stated, this invention is practiced in one form by introducing a liquid through at least one nozzle into a hot gas conduit in close proximity to a source of flammable material located within the conduit. A particular embodiment is for use as a fire suppression system in a thermal oil heat exchanger where water is sprayed into the conduit where it turns to steam and serves to cool the interior while supplanting oxygen within the hot gas stream.

DETAILED DESCRIPTION OF THE PREFERRED EMBODIMENT

Figures 1, 2:
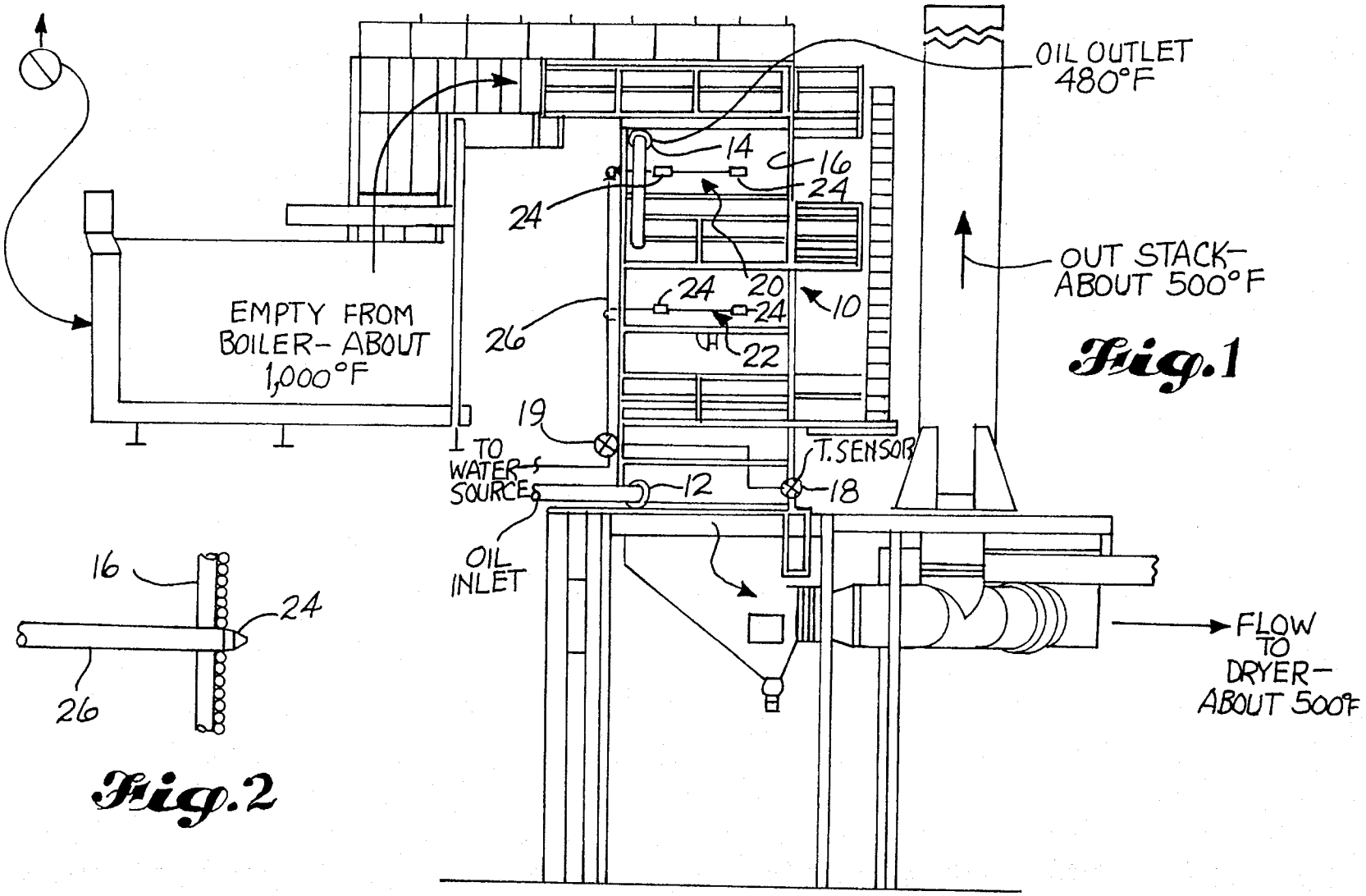
FIG. 1 is a representation of a hot gas conduit with a heat exchanger and showing the location of the nozzles.
FIG. 2 is a side view showing a typical nozzle with its output end directed into the hot gas conduit.

The present invention will be described by first referring to FIG. 1. In FIG. 1 there is depicted a typical thermal oil heater, indicated generally at 10. These units are common, for example, in the wood products industry where boilers are utilized at manufacturing facilities to generate heat which can be used for a variety of purposes, such as, to heat the oil in a thermal oil heat exchanger. The heated oil is then used within the manufacturing facility, for example to heat the platens of a hot press.

Heater 10 is one that is commercially available from a supplier such as the Wellons Company of Sherwood, Oreg. It's detailed construction will not be described, however, it is typical in that it is a closed circuit unit having an inlet end 12 and an outlet end 14 with the outlet end being upstream (in the hot gas conduit) from the inlet end. Within the hot gas conduit, indicated generally at 16, oil piping will be structured in a known circuitous manner. Functionally, of course, relatively cool oil enters inlet end 12 (being circulated via an upstream pump) after which it circulates through the circuitous piping within the hot gas steam, thereafter exiting through outlet end 14. Typically the oil will be allowed to remain within the heater a time (given flow rates, piping size, materials) sufficient to raise its temperature to about 480° F. at the outlet end 14. This temperature is satisfactory, for example, for utilization of the oil within a hot press. Usually hot gas temperatures from the upstream boiler (not shown) entering the heater section are at about 1,000° F. and after passing through heater 10, giving up heat to the circulating oil, will be about 500° F.

In the embodiment depicted, with gas temperatures being what they are and the oil usually having a flash point of around 380° F., if a leak develops in the oil line within conduit 16, a fire situation will arise if there is an oxygen content in the hot gas of about 15% or above. Leaking oil, under these conditions will ignite and burn, causing damage to the heater section and to both upstream and downstream components. If a leak occurs and a fire condition exists, the first step in the present process is detection of the elevated temperature.

Typically, an elevated temperature of 750° F. of the gas exiting the heater section will indicate a fire condition and any suitable temperature detector 18 or plurality of detectors can be used for the purpose. Redundancy is preferred to assure an accurate and reliable detection when the limit temperature is reached. A suitable signal is generated which is immediately sent to a valve controller 19 which operates to send water to nozzles 24.

Strategically located within the heater 10 are first and second sets of inwardly directed water spray nozzles, 20, 22 respectively. Each set is comprised of a plurality of separate spray nozzles, each indicated at 24. Each nozzle 24 is supplied via a common water supply line indicated at 26. Nozzles 24 in the first and second sets 20, 22 are directed inwardly within heater section 10 and when activated will be selected so as to generate enough spray flow to have the water absorb a significant amount of the heat energy as it flashes into steam. The steam thereafter flows outwardly through conduit 16 carrying the excess heat while serving to cool the interior parts and extinguish the fire since the oxygen content of the hot gases will be reduced as more steam is generated. Sizing of the nozzles, their location, and flow rates will be determined for each installation according to its size. For larger thermal heaters more steam will be required due to the larger volumes. Such design considerations are well within the ordinary skill of the fire control art. A suitable source for the water spray nozzles is Bete Fog Nozzle, Inc. of Greenfield, Mass. A typical water flow rate to accomplish the cooling and extinguishing function of the present invention is 8 lb. per minute water flow per 100 cubic feet of internal conduit volume.

Thus, what has been described is a method and apparatus for detecting a fire in a thermal heater and by the use of strategically located water spray nozzles suppressing the fire and cooling the equipment by creating a sufficient amount of steam to snuff out the fire. Upon detection of the high temperature of a fire, the control system will activate water flow to the nozzles. After suppression, any leaks in the oil circulation system are repaired.

While a detailed description has been given, various modifications and changes may occur to those having ordinary skill in the art. All such changes and modifications are intended to be included within the scope of the following claims.

I claim:

1. An apparatus comprising:

a heat exchanger having a plurality of thermal heater tubes mounted in a conduit, wherein a flammable liquid flows through the heater tubes, and a hot combustion gas, having an oxygen content that supports combustion and a temperature above the ignition temperature of the flammable liquid, flows through the conduit in a flow path; and a fire suppression system comprising:

means to detect the presence of a fire in proximity to the heater tubes;

a plurality of cooling liquid spray nozzles mounted within said conduit and directed into the hot gas flow path and generally towards the heater tubes;

means for activating the liquid spray nozzles upon the detection of a fire and for generating a steam flow rate within the conduit sufficient to thereby suppress the fire and cool the heat exchanger in the vicinity of the thermal heater tubes.

* * * * *